US009595792B2

(12) United States Patent
Nishimura et al.

(10) Patent No.: US 9,595,792 B2
(45) Date of Patent: Mar. 14, 2017

(54) CABLE WITH CONNECTOR

(71) Applicant: Hitachi Metals, Ltd., Tokyo (JP)

(72) Inventors: Kei Nishimura, Hitachi (JP); Izumi Fukasaku, Hitachi (JP); Takahiro Sugiyama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 7 days.

(21) Appl. No.: 14/539,643

(22) Filed: Nov. 12, 2014

(65) Prior Publication Data

US 2015/0194719 A1 Jul. 9, 2015

(30) Foreign Application Priority Data

Jan. 6, 2014 (JP) ..... 2014-000343

(51) Int. Cl.
*H01P 5/08* (2006.01)
*H01R 13/6473* (2011.01)

(52) U.S. Cl.
CPC ..... *H01R 13/6473* (2013.01)

(58) Field of Classification Search
CPC ..... H01R 13/6473
USPC ..... 333/28 R
See application file for complete search history.

(56) References Cited

U.S. PATENT DOCUMENTS 5,138,287 A * 8/1992 Domokos ..... H01P 5/12 333/12
2008/0094151 A1* 4/2008 Savi ..... H01R 13/6658 333/28 R
2010/0029104 A1* 2/2010 Patel ..... H01R 13/6658 439/76.1
2012/0007688 A1* 1/2012 Zhou ..... H05K 1/0245 333/4
2012/0309233 A1* 12/2012 O'Malley ..... H01R 13/6469 439/626

(Continued)

FOREIGN PATENT DOCUMENTS

JP 2010-211937 A 9/2010
JP 2011-090959 A 5/2011
JP 2013-122825 A 6/2013

OTHER PUBLICATIONS

Japanese Office Action dated Nov. 1, 2016 and English translation thereof.

*Primary Examiner* — Stephen E Jones
*Assistant Examiner* — Scott S Outten
(74) *Attorney, Agent, or Firm* — McGinn IP Law Group, PLLC.

(57) ABSTRACT

A cable with connector includes a cable including at least two or more differential signal transmission cables for transmitting/receiving differential signals, a connector at both ends of the cable and including a built-in paddle card to electrically connect the differential signal transmission cables to a connected device. The paddle card includes a sending-side transmission path that is formed on the paddle card so as to transmit electrical signals input from the device to the differential signal transmission cables. The sending-side transmission path includes a common-mode reflecting transmission path that is in a common-mode impedance mismatched to a transmission path of the device so as to reflect common-mode signals input from the transmission path of the device.

12 Claims, 2 Drawing Sheets

(56) References Cited

U.S. PATENT DOCUMENTS

2013/0225009 A1* 8/2013 Hashim ..... H01R 13/6466
439/676

* cited by examiner

CABLE WITH CONNECTOR

The present application is based on Japanese patent application No. 2014-000343 filed on Jan. 6, 2014, the entire contents of which are incorporated herein by reference.

BACKGROUND OF THE INVENTION

1. Field of the Invention

The invention relates to a cable with connector.

2. Description of the Related Art

A cable with connector is known which is provided with a cable including differential signal transmission cables for transmitting/receiving differential signals and connectors provided at both ends of the cable.

The connector has a built-in paddle card for electrically connecting the differential signal transmission cables to a connected device. There is a product called an active cable module (also called an active direct attach cable, an active DAC or an active copper cable (ACC)) which is provided with a compensation circuit for actively compensating electrical signals according to loss characteristics of the differential signal transmission cables and then outputting the compensated signals on a receiving-side transmission path in the paddle card, i.e., on a transmission path for transmitting electrical signals input from the differential signal transmission cables to the device.

JP-A-2011-90959 and JP-A-2013-122825 may be prior art documents related to the present invention.

SUMMARY OF THE INVENTION

In the cable with connector such as the active cable module, a signal level difference between the sending side and the receiving side becomes large especially in long-distance transmission using a long cable and it is more susceptible to near-end crosstalk due to common mode.

The conventional cables with connector may have the problem that a common-mode signal, when input from the connected device, is transmitted to the cable and near-end crosstalk due to common mode is thereby increased.

It is an object of the invention to provide a cable with connector that reduces the near-end crosstalk due to common mode.

(1) According to one embodiment of the invention, a cable with connector comprises:

a cable comprising at least two or more differential signal transmission cables for transmitting/receiving differential signals;

a connector at both ends of the cable and comprising a built-in paddle card to electrically connect the differential signal transmission cables to a connected device, wherein the paddle card comprises a sending-side transmission path to transmit electrical signals input from the device to the differential signal transmission cables, and wherein the sending-side transmission path comprises a common-mode reflecting transmission path that is in a common-mode impedance mismatched to a transmission path of the device so as to reflect common-mode signals input from the transmission path of the device.

In the above embodiment (1) of the invention, the following modifications and changes can be made.

(i) The common-mode reflecting transmission path is configured to be mismatched in the common-mode impedance and matched in a differential-mode impedance to the transmission path of the device.

(ii) The common-mode reflecting transmission path is formed by partially changing a space in a wiring pattern constituting the sending-side transmission path.

(iii) The paddle card further comprises a compensation circuit for compensating electrical signals input from the differential signal transmission cables according to loss characteristics of the differential signal transmission cables and outputting the compensated signals on a receiving-side transmission path to transmit electrical signals input from the differential signal transmission cables to the device.

(iv) At least a portion of the common-mode reflecting transmission path on the sending-side transmission path is formed on a side of the device with respect to the compensation circuit.

(v) Substantially an entirety of the sending-side transmission path forms the common-mode reflecting transmission path.

(vi) The differential signal transmission cable is in the common-mode impedance higher than the transmission path of the device, and wherein the common-mode reflecting transmission path is in the common-mode impedance equivalent to the differential signal transmission cable.

(vii) The differential signal transmission cables each comprise two inner conductors arranged in parallel, an insulation collectively covering around the inner conductors, and an outer conductor formed around the insulation.

Advantageous Effects of the Invention

According to one embodiment of the invention, a cable with connector can be provided that reduces the near-end crosstalk due to common mode.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiments of the invention will be described below in conjunction with the appended drawings.

Figure 1A:
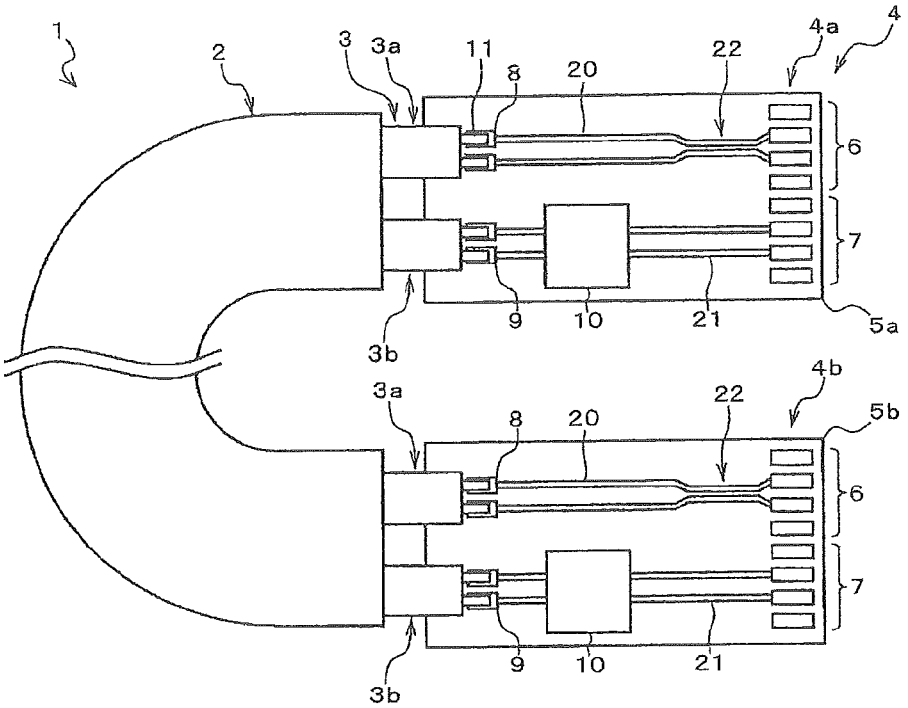
FIG. 1A is a schematic diagram illustrating a cable with connector in an embodiment of the present invention.
Figure 1B:
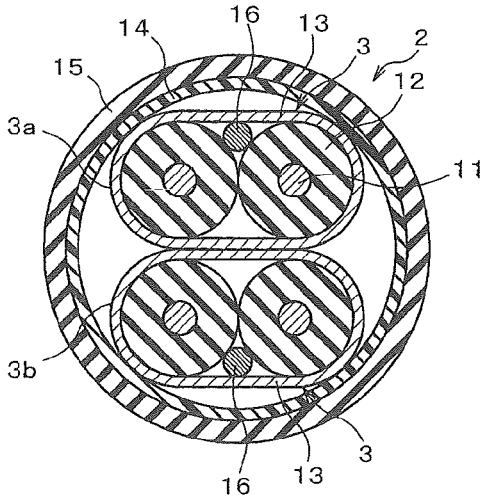
FIG. 1B is a cross sectional view showing a cable used in the cable with connector of FIG. 1A.

FIG. 1A is a schematic diagram illustrating a cable with connector in the present embodiment and FIG. 1B is a cross sectional view showing a cable.

As shown in FIGS. 1A and 1B, a cable with connector 1 is provided with a cable 2 including at least two or more differential signal transmission cables 3 for transmitting/receiving differential signals, and connectors 4 provided at both ends of the cable 2.

The configuration using the cable 2 provided with two differential signal transmission cables 3 to allow for one channel transmission and reception will be described in the present embodiment. The cable 2 is formed by bundling two differential signal transmission cables 3 and then sequentially providing a binding tape 14 and a jacket 15 thereabout.

The differential signal transmission cable 3 used here is a so-called twinax cable which is provided with two inner conductors 11 arranged in parallel, insulations 12 separately covering around the inner conductors 11 and an outer conductor 13 formed around the insulations 12. In the differential signal transmission cable 3, a drain wire 16 for grounding the outer conductor 13 is provided between the outer conductor 13 and the insulations 12. Hereinafter, one of the two differential signal transmission cable 3 is called a first differential signal transmission cable 3*a* and another is called a second differential signal transmission cable 3*b*.

A first connector 4*a* is provided at one end of the cable 2 (on the upper side in FIG. 1A) and a second connector 4*b* is provided at another end (on the lower side in FIG. 1A). Each of the connectors 4*a* and 4*b* has a built-in paddle card 5 which electrically connects the differential signal transmission cables 3 to a connected device (not shown). Hereinafter, the paddle card 5 provided in the first connector 4*a* is called a first paddle card 5*a* and the paddle card 5 provided in the second connector 4*b* is called a second paddle card 5*b*.

Plural sending-side electrodes 6 and plural receiving-side electrodes 7, which are to be connected to a device, are formed on one end portion of each of the paddle cards 5*a* and 5*b* (one end portion opposite to the side connected to the cable 2).

In addition, sending-side cable connection electrodes 8 and receiving-side cable connection electrodes 9, which are connected to the inner conductors 11 of the differential signal transmission cables 3 of the cable 2, are formed on another end portion of each of the paddle cards 5*a* and 5*b*.

The inner conductors 11 of the first differential signal transmission cable 3*a* are connected, at one end, to the sending-side cable connection electrodes 8 of the first paddle card 5*a* and are connected, at another end, to the receiving-side cable connection electrodes 9 of the second paddle card 5*b*. The inner conductors 11 of the second differential signal transmission cable 3*b* are connected, at one end, to the receiving-side cable connection electrodes 9 of the first paddle card 5*a* and are connected, at another end, to the sending-side cable connection electrodes 8 of the second paddle card 5*b*.

The sending-side electrodes 6 are electrically connected to the sending-side cable connection electrodes 8 via a sending-side transmission path 20 consisting of a wiring pattern formed on each of the paddle cards 5*a* and 5*b*. Through the sending-side transmission path 20, electrical signals input from the device via the sending-side electrodes 6 are transmitted to the sending-side cable connection electrodes 8 and then to the differential signal transmission cable 3*a* or 3*b*.

The receiving-side electrodes 7 are electrically connected to the receiving-side cable connection electrodes 9 via a receiving-side transmission path 21 consisting of a wiring pattern formed on each of the paddle cards 5*a* and 5*b*. Through the receiving-side transmission path 21, electrical signals input from the differential signal transmission cable 3*a* or 3*b* via the receiving-side cable connection electrodes 9 are transmitted to the receiving-side electrodes 7 and then to a device.

The receiving-side transmission path 21 is provided with a compensation circuit 10 by which electrical signals input from the differential signal transmission cable 3*a* or 3*b* via the receiving-side cable connection electrodes 9 are actively compensated according to loss characteristics of the differential signal transmission cable 3*a* or 3*b* and are then output. That is, the cable with connector 1 is an active cable module in which each connector 4 is provided with the compensation circuit 10.

In addition, the drain wires 16 of the differential signal transmission cables 3*a* and 3*b* are connected to ground patterns of the paddle cards 5*a* and 5*b* even though the illustration is omitted.

The electrical signals input to the first connector 4*a* from the device are input via the sending-side electrodes 6, the sending-side transmission path 20, the sending-side cable connection electrodes 8 and the inner conductors 11 of the differential signal transmission cable 3*a* to the second connector 4*b* and is output via the receiving-side cable connection electrodes 9, the receiving-side transmission path 21, the compensation circuit 10 and the receiving-side electrodes 7 to a device which is connected to the second connector 4*b*. The signals are transmitted from the second connector 4*b* to the first connector 4*a* in the same manner.

In the cable with connector 1 of the present embodiment, the sending-side transmission path 20 of the paddle card 5*a*, 5*b* includes a common-mode reflecting transmission path 22 which has a common-mode impedance mismatched to that of a transmission path of the device and reflects common-mode signals input from the transmission path of the device.

The common-mode reflecting transmission path 22 is configured to have a differential-mode impedance matched to that of the transmission path of the device so that differential-mode signals, which are the electrical signals input from the device, are not reflected. In other words, the common-mode reflecting transmission path 22 is configured to have a mismatched common-mode impedance and a matched differential-mode impedance relative to the transmission path of the device.

In the present embodiment, a space in a wiring pattern constituting the sending-side transmission path 20 is partially changed to vary a coupling factor, thereby forming the common-mode reflecting transmission path 22. The coupling factor here is increased by partially narrowing the space in the wiring pattern constituting the sending-side transmission path 20 to increase a common-mode impedance of the common-mode reflecting transmission path 22.

In more detail, the common-mode impedance of the transmission path of the device is generally about 25Ω and, in this case, the common-mode impedance of the common-mode'reflecting transmission path 22 is adjusted to not less than 25Ω. For example, when using the differential signal transmission cable 3 with a common-mode impedance of 37.5Ω, the common-mode impedance of the common-mode reflecting transmission path 22 is desirably around 37.5Ω.

In the cable with connector 1, the sending-side transmission path 20 excluding the common-mode reflecting transmission path 22 and the receiving-side transmission path 21 are formed to match to the transmission path of the device in both the differential and common modes.

The common-mode reflecting transmission path 22 is desirably formed in the vicinity of the sending-side electrodes 6 connected to the transmission path of the device in order to reduce common-mode signals introduced into the cable with connector 1 as much as possible, and is desirably at least partially formed in the sending-side transmission path 20 on the device side with respect to the compensation circuit 10 (on the sending-side electrode 6 side, i.e., opposite to the cable 2).

The reason is as follows. In long-distance transmission, a signal level of the receiving-side transmission path 21 is decreased on the cable 2 side of the compensation circuit 10.

Therefore, when a high level common-mode signal is transmitted through the sending-side transmission path 20 in the vicinity thereof, i.e., through the sending-side transmission path 20 on the cable 2 side with respect to the compensation circuit 10, near-end crosstalk due to common mode may be increased. In the cable with connector 1, the signal level is increased by amplification in the compensation circuit 10 and the effect on near-end crosstalk is thereby relatively small in the receiving-side transmission path 21 on the device side of the compensation circuit 10 (on the receiving-side electrode 7 side, i.e., opposite to the cable 2).

As described above, in the cable with connector 1 of the present embodiment, the sending-side transmission path 20 includes the common-mode reflecting transmission path 22 which has a common-mode impedance mismatched to that of the transmission path of the device and reflects common-mode signals input from the transmission path of the device.

The common-mode reflecting transmission path 22 allows the common-mode signals input from the device to be reflected on the paddle card 5. As a result, even when a signal level difference between the sending side and the receiving side is large, such as in the case of long-distance transmission using a long cable 2, near-end crosstalk due to common mode can be reduced.

In addition, since the common-mode reflecting transmission path 22 in the present embodiment is configured to have a mismatched common-mode impedance and a matched differential-mode impedance relative to the transmission path of the device, it is possible to reflect only common-mode signals without any effect on differential-mode signals.

Other embodiments of the invention will be described.

Figure 2:
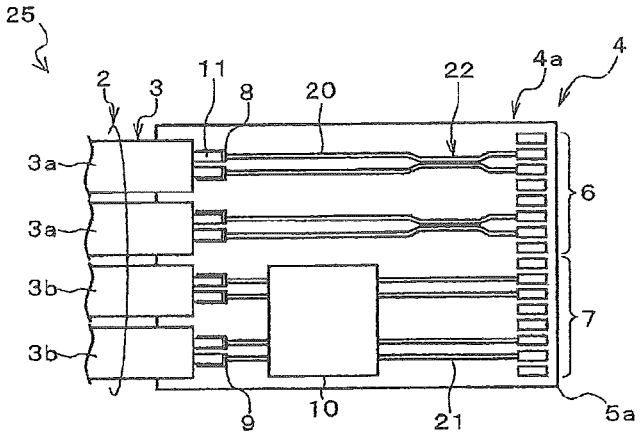
FIG. 2 is a schematic diagram illustrating a cable with connector in another embodiment of the invention.

A cable with connector 25 shown in FIG. 2 is based on the cable with connector 1 shown in FIGS. 1A and 1B but the cable 2 is provided with two each of the differential signal transmission cables 3*a* and 3*b* and each of the paddle cards 5*a* and 5*b* has two sets of the sending-side electrodes 6, the receiving-side electrodes 7, the sending-side cable connection electrodes 8, the receiving-side cable connection electrode 9, the sending-side transmission path 20 and the receiving-side transmission path 21 so as to correspond to the each of the differential signal transmission cables 3*a* and 3*b*. A compensation circuit 10 for two channels is used here but two compensation circuits 10 for one channel may be used.

The cable with connector 25 is provided with two sending-side transmission paths 20. Therefore, the common-mode reflecting transmission path 22 is formed on each of the two sending-side transmission paths 20. It is thereby possible to obtain the same functions and effects as the cable with connector 1 of FIGS. 1A and 1B.

Although the cable with connector 1 shown in FIGS. 1A and 1B configured to allow for one channel transmission and reception and the cable with connector 25 shown in FIG. 2 configured to allow for two channel transmission and reception have been described, it is not limited thereto. It is obviously possible to configure to allow for three or more channel transmission and reception.

Figure 3A:
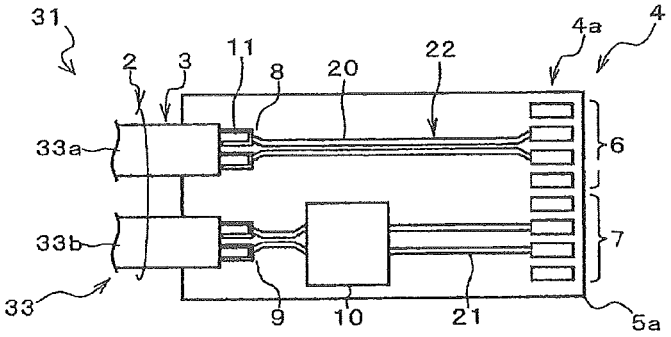
FIG. 3A is a schematic diagram illustrating a cable with connector in yet another embodiment of the invention.

A cable with connector 31 shown in FIG. 3A is based on the cable with connector 1 shown in FIGS. 1A and 1B but the entire sending-side transmission path 20 is configured as the common-mode reflecting transmission path 22.

The longer the common-mode reflecting transmission path 22, the lower the frequency of the common mode to be reflected. Therefore, configuring the entire sending-side transmission path 20 as the common-mode reflecting transmission path 22 allows near-end crosstalk due to common mode to be further reduced.

Furthermore, in the cable with connector 31, a portion of the receiving-side transmission path 21 between the receiving-side cable connection electrodes 9 and the compensation circuit 10 is also formed as the common-mode reflecting transmission path 22 of which common-mode impedance is equalized to that of the differential signal transmission cables 3.

Since this provides a common-mode impedance match in all transmission paths from the sending-side electrodes 6 through the differential signal transmission cables 3 to the compensation circuit 10, a reflection point for reflecting common-mode signals can be limited to one position. When there are plural reflection points, high radiation may be considered to occur due to multiple reflections in the common mode. In contrast, limiting to one reflection point allows radiation due to multiple reflections in the common mode to be suppressed.

In the cable with connector 31, it is necessary to use the differential signal transmission cables with a higher common-mode impedance than the transmission path of the device (i.e., the differential signal transmission cables of which common-mode impedance does not match to that of the transmission path of the device).

Figure 3B:
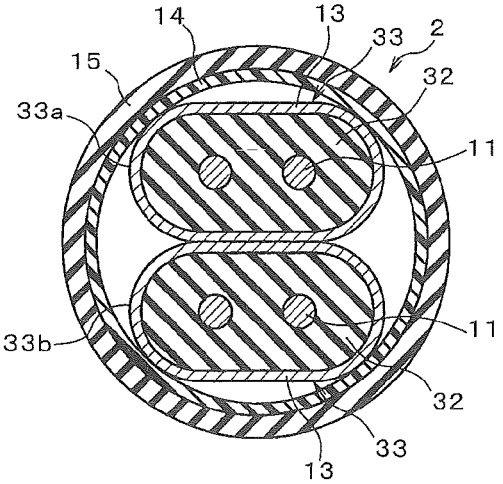
FIG. 3B is a cross sectional view showing a cable used in the cable with connector of FIG. 3A.

Thus, a differential signal transmission cable 33 (33*a*, 33*b*), in which two inner conductors 11 arranged in parallel is collectively covered with an insulation 32 and then the outer conductor 13 is provided therearound as shown in FIG. 3B, is used instead of the differential signal transmission cable 3. The differential signal transmission cable 33 has a relatively high common-mode impedance of, e.g., 37.5Ω and is suitable as the differential signal transmission cable used for the cable with connector 31.

For cable with connectors, there is a standard which specifies a common mode return loss on the receiving side. The cable with connectors 1, 25 and 31 of the invention can meet such a standard since the compensation circuit 10 using an IC is provided in the receiving-side transmission path 21. In other words, in the cable with connectors 1, 25 and 31, since a connected portion of the receiving-side transmission path 21, extending from the receiving-side electrode 7, to the compensation circuit 10 can be considered a free end, common-mode signals input from the receiving-side electrodes 7 are not reflected by the common-mode reflecting transmission path 22 and it is thus possible to suppress a common mode return loss on the receiving side.

The present invention is not intended to be limited to the embodiments, and it is obvious that the various kinds of changes can be made without departing from the gist of the invention.

What is claimed is:

1. A cable with connector, comprising:

a cable comprising at least two or more differential signal transmission cables for transmitting or receiving differential signals; and a connector at both ends of the cable and comprising a built-in paddle card to electrically connect the differential signal transmission cables to a connected device, wherein the built-in paddle card comprises a sending-side transmission path to transmit electrical signals input from the connected device to the differential signal transmission cables, wherein the sending-side transmission path comprises a common-mode reflecting transmission path that is in a common-mode impedance mismatched to a transmission path of the connected device so as to reflect common-mode signals input from the transmission path of the connected device, wherein the common-mode reflecting transmission path is provided by changing a distance in a wiring pattern of the sending-side transmission path, wherein the built-in paddle card further comprises a compensation circuit for compensating electrical signals input from the differential signal transmission cables according to loss characteristics of the differential signal transmission cables and outputting the compensated signals on a receiving-side transmission path to transmit electrical signals input from the differential signal transmission cables to the connected device, wherein substantially an entirety of the sending-side transmission path forms the common-mode reflecting transmission path, wherein a common-mode impedance of the differential signal transmission cables is higher than a common-mode impedance of the transmission path of the connected device, and a common-mode impedance of the common-mode reflecting transmission path is equal to the common-mode impedance of the differential signal transmission cables.

2. The cable with connector according to claim 1, wherein a width of a space in the wiring pattern of the sending-side transmission path changes along a length of the sending-side transmission path to provide the common-mode reflecting transmission path.

3. The cable with connector according to claim 2, wherein at least a portion of the common-mode reflecting transmission path on the sending-side transmission path is formed on a side of the connected device with respect to the compensation circuit.

4. The cable with connector according to claim 2, further comprising:

sending-side electrodes connected to the connected device, wherein a distance between parallel portions in the wiring pattern forming the common-mode reflecting transmission path is smaller than a distance between parallel portions between the sending-side electrodes.

5. The cable with connector according to claim 1, wherein at least a portion of the common-mode reflecting transmission path on the sending-side transmission path is formed closer to a side of the connected device than the compensation circuit to the side of the connected device.

6. A cable with connector, comprising:

a cable comprising at least two or more differential signal transmission cables for transmitting or receiving differential signals; and a connector at both ends of the cable and comprising a built-in paddle card to electrically connect the differential signal transmission cables to a connected device, wherein the built-in paddle card comprises a sending-side transmission path to transmit electrical signals input from the connected device to the differential signal transmission cables, wherein the sending-side transmission path comprises a common-mode reflecting transmission path that is in a common-mode impedance mismatched to a transmission path of the connected device so as to reflect common-mode signals input from the transmission path of the connected device, wherein the common-mode reflecting transmission path is provided by changing a distance in a wiring pattern of the sending-side transmission path, wherein the common-mode reflecting transmission path is configured to be mismatched in the common-mode impedance and matched in a differential-mode impedance to the transmission path of the connected device, wherein the built-in paddle card further comprises a compensation circuit for compensating electrical signals input from the differential signal transmission cables according to loss characteristics of the differential signal transmission cables and outputting the compensated signals on a receiving-side transmission path to transmit electrical signals input from the differential signal transmission cables to the connected device, wherein substantially an entirety of the sending-side transmission path forms the common-mode reflecting transmission path, and wherein a common-mode impedance of the differential signal transmission cables is higher than a common-mode impedance of the transmission path of the connected device, and a common-mode impedance of the common-mode reflecting transmission path is equal to the common-mode impedance of the differential signal transmission cables.

7. The cable with connector according to claim 6, wherein a width of a space in the wiring pattern of the sending-side transmission path changes along a length of the sending-side transmission path to provide the common-mode reflecting transmission path.

8. The cable with connector according to claim 6, wherein at least a portion of the common-mode reflecting transmission path on the sending-side transmission path is formed on a side of the connected device with respect to the compensation circuit.

9. The cable with connector according to claim 6, wherein the mismatch of the common-mode impedance is provided only at one end of the differential signal transmission cables.

10. The cable with connector according to claim 6, wherein the compensation circuit is provided only at one end of the differential signal transmission cables.

11. A cable with connector, comprising:

a cable comprising at least two or more differential signal transmission cables for transmitting or receiving differential signals; and a connector at both ends of the cable and comprising a built-in paddle card to electrically connect the differential signal transmission cables to a connected device, wherein the built-in paddle card comprises a sending-side transmission path to transmit electrical signals input from the connected device to the differential signal transmission cables, wherein the sending-side transmission path comprises a common-mode reflecting transmission path that is in a common-mode impedance mismatched to a transmission path of the connected device so as to reflect common-mode signals input from the transmission path of the connected device, wherein the common-mode reflecting transmission path is provided by changing a distance in a wiring pattern of the sending-side transmission path, wherein substantially an entirety of the sending-side transmission path forms the common-mode reflecting transmission path, and wherein a common-mode impedance of the differential signal transmission cables is higher than a common-mode impedance of the transmission path of the connected device, and a common-mode impedance of the common-mode reflecting transmission path is equal to the common-mode impedance of the differential signal transmission cables.

12. The cable with connector according to claim 11, wherein the differential signal transmission cables each comprise two inner conductors arranged in parallel, an insulation collectively covering around the inner conductors, and an outer conductor formed around the insulation.

* * * * *